United States Patent [19]

Rood

[11] Patent Number: 4,905,054

[45] Date of Patent: Feb. 27, 1990

[54] METHOD AND APPARATUS FOR PRODUCING CORNER-BOUND PORTRAIT AND LANDSCAPE DOCUMENT SETS

[75] Inventor: Allan J. Rood, Boulder, Colo.

[73] Assignee: International Business Machines Corporation, Armonk, N.Y.

[21] Appl. No.: 290,674

[22] Filed: Dec. 27, 1988

[51] Int. Cl.[4] ..... G03G 15/00

[52] U.S. Cl. ..... 355/324; 355/318; 271/186; 270/53

[58] Field of Search ..... 355/324, 318, 319, 320, 355/322; 271/225, 3.1, 184, 186

[56] References Cited

U.S. PATENT DOCUMENTS

| | | | |
|---|---|---|---|
| 4,083,550 | 4/1978 | Pal | 270/53 |
| 4,238,066 | 12/1980 | Brooke | 227/39 |
| 4,281,920 | 8/1981 | Cross | 355/75 |
| 4,329,046 | 5/1982 | Burkett et al. | 355/77 |
| 4,558,942 | 12/1985 | Chiama | 355/324 X |
| 4,564,185 | 1/1986 | Hamlin et al. | 270/53 |
| 4,681,310 | 7/1987 | Cooper | 270/53 |
| 4,687,191 | 8/1987 | Stemmle | 270/53 |
| 4,763,167 | 8/1988 | Watanabe et al. | 355/324 X |

*Primary Examiner*—A. C. Prescott

*Attorney, Agent, or Firm*—Charles E. Rohrer; Francis A. Sirr

[57] ABSTRACT

A xerographic reproduction device is disclosed, the device having a recirculating automatic document feeder that includes a sheet invertor, and a print path that includes a print station, a sheet invertor and a document set accumulator. The set accumulator includes a horizontal tray where at the individual sheets of a document set are stacked, one by one in proper page sequence. A stitcher is mounted in a fixed position at one leading-edge corner of the tray, so as to be coincident with a leading corner of the set. The individual sheets of portrait sets exit the print path and enter the accumulator tray, to reside in the tray with the set's first page on top of the set, facing upward, and with the stitcher located so as to bind the set's upper left hand corner. The individual sheets of landscape sets exit the print path and enter the accumulator tray, to reside in the tray with the set's first page on the bottom of the set, facing downward, and with the stitcher located so as to also bind the set's upper left hand corner.

22 Claims, 2 Drawing Sheets

METHOD AND APPARATUS FOR PRODUCING CORNER-BOUND PORTRAIT AND LANDSCAPE DOCUMENT SETS

FIELD OF THE INVENTION

This invention relates to the field of printing, and more specifically to the production of corner-bound portrait-orientation and landscape-orientation document sets.

BACKGROUND AND SUMMARY OF THE INVENTION

A portrait document is understood in the art to be a document whose upright image, when viewed while holding the document sheet vertical, causes the sheet's long-dimension edges to extend vertically, and its short-dimension edges to extend horizontally. For example, for a portrait document on 8×11 inch paper, the 11 inch edges extend vertically and the 8 inch edges extend horizontally.

A landscape document is understood in the art to be a document whose upright image, when viewed while holding the document sheet vertical, causes the sheet's short-dimension edges to extend vertically, and its long-dimension edges to extend horizontally. Thus, for a landscape document on 8×11 inch paper, the 8 inch edges extend vertically and the 11 inch edges extend horizontally.

When multi-sheet portrait and landscape document sets are corner-bound, it is usual that the sets be bound at the same common corner. Usually, this common-corner is the upper left-hand corner of the set, this corner being defined as the sets are held vertically, with the image in its correct reading orientation.

As the term "common-corner", as used herein, it will be the upper left hand corner of the set, this corner being defined as the set is held vertically with the image in right-reading orientation. However, within the spirit and scope of the invention, the common-corner can be any of the four corners of the sets, so long as the same image-relative corner is bound for both type of sets.

Printers typically process blank sheets of paper as the sheet moves with the same leading-edge sheet orientation while producing both types of sets. For example, the sheets may move through the portrait/landscape print station with either a short sheet edge as the leading edge, or with a long sheet edge as the leading edge. In the description of preferred embodiments that follows, the sheets move with a long edge as the leading edge. However, the spirit and scope of the invention is not to be limited thereto.

Prior art printers do not use one, fixed-position binding device to common-corner bind both types of sets. That is, either two binders were provided in the prior art, or one binder moves between the ends of the set's leading edge, depending upon the type of set being bound.

For example, consider FIG. 1. This figure first shows the top view of a prior art vertical-stack set 10 that has been printed, either simplex or duplex, in the portrait mode of operation of a reproduction device such as a printer. If this set comprises simplex pages 1 through N, page N is printed first, and page N is then placed on an accumulator tray with its image facing upward. The last sheet of set 10 to be printed is page 1. This sheet is then placed as the top sheet of set 10, image facing upward. In this example, page 1 has an arrow printed thereon in portrait orientation, the letters "L" and "R" showing the left-to-right reading direction of the portrait image.

All of the individual sheets of set 10 pass through a print station (not shown) with their long edge 11 as the leading edge. Common-corner binding of set 10 requires that a fastener device, for example a stitcher or a stapler, be placed to cooperate with the upper left hand corner 12 of set 10.

FIG. 1 also shows the top view of a prior art vertical-stack set 13 of sheets that are printed in the landscape orientation. The first or top sheet of this set (i.e. set page 1) also has an arrow printed thereon. The sheets of set 14 also move through the print station with the same long edge 11 as the sheet's leading edge. Common-corner binding of set 13, however, requires that a fastener be placed at upper left hand corner 14 of the set. Note that corner 14 is at the opposite leading-edge corner of the sheet from the leading edge corner 12 that was used for portrait set 10.

FIG. 1 is exemplary of the prior art, where in order to common-corner bind both a portrait set 10 and a landscape set 13, it was necessary to either provide two binding devices, one located at each of the leading-edge corners 12, 14, or in the alternative, a single, movable, binding device was provided, and the binding device was moved to leading edge corner 12 when portrait sets were being produced, and was moved to leading-edge corner 14 when landscape sets were being produced.

FIG. 2 shows a portrait set and a landscape set that have been printed in accordance with the method and apparatus of the present invention. This figure is the top view of a vertical-stack set 15 of sheets that have been printed, either simplex or duplex, in the portrait mode in accordance with an embodiment of the invention. Assuming the sheets are printed simplex, page 1 of set 15 again has an arrow printed thereon in portrait orientation, and the image faces upward. The sheets of set 15 move through the print station (see 34 of FIG. 3) with long edge 16 as the sheet's leading edge. Commom-corner binding requires that a fastening device, such as a stitcher, a stapler, a corner adhesive means or a punch-/rivet means be placed at upper left hand corner 17 of portrait set 15.

FIG. 2 also shows the top view of a vertical-stack set 18 of simplex sheets that are printed in the landscape mode. However, in this case the top sheet of the set is the set's Nth sheet. This top sheet again has an arrow printed thereon in landscape orientation, and the image of the Nth sheet, as well as the landscape images of all of the simplex sheets 1 through N, reside in set 18 with their images facing downward. In FIG. 2 the image on the top sheet of set 18 is shown dotted to signify that the simplex image is facing downward.

The sheets of landscape set 18 also move through the station with the same long sheet edge 16 as the sheet's leading edge. However, all sheets of set 18 are inverted prior to being stacked in the accumulator tray. As a result, sometime prior to stacking, sheet edge 16 becomes the sheet's trailing edge.

The sheet that corresponds to page 1 of landscape set 18 is on the bottom of the set, image facing downward. Common-corner binding of landscape set 18 now allows the same fastener to be used, located at the same upper left hand corner 17 as was used for portrait set 15. When landscape set 18 is lifted and held vertically for reading, it is now found that leading edge corner 17 of set 18 is at the upper left hand corner of the set, and the set is common-corner bound in the same manner as portrait set 15.

The above description of FIG. 2 relates to the use of a print station to selectively print either portrait or landscape simplex images on the same side of sheets that come from a supply bin containing a stack of blank sheets. For example, a xerographic reproduction device may operate to feed sheets, one at a time, to a transfer station from a stack of blank sheets. At the transfer station toner is transferred to one side of the sheet, for example the top surface of the sheet. This type of exemplary xerographic device may be either a copier or a printer.

By definition, a copier is a device that reproduces visual images that are carried by the surface(s) of original document sheets, whereas a printer is a device that reproduces electronic-signal images that are supplied to a printhead by a data processor or the like.

In accordance with the invention, the individual sheets of portrait set 15 and landscape set 18 are relatively inverted, for example the sheets of set 15 are not inverted whereas the sheets of set 18 are inverted, prior to being stacked and presented for corner binding by the fastener that is located at corner 17.

The scope and content of the present invention is to provide common-corner binding of both landscape and portrait sets, using only one binding device that is mounted at a fixed position at a location(s) where the sets are accumulated for binding.

As those skilled in the art will readily appreciate, the invention is useful both where a single accumulator tray is used, and where a multi-bin collator is used to accumulate the sets, for example. The term "accumulator means or tray" as used herein is therefor understood to encompass all such means.

In addition, those skilled in the art will understand that the invention is applicable to reproduction devices that feed paper through the print station short edge first, and to reproduction devices that print an image on the top and/or the bottom surface of a sheet. Another printing/sheet-feeding variable that can be adapted to the present invention is the reading direction of the image that is printed on the sheet's surface.

Thus, while the present invention will be described with reference to a reproduction device in which paper is fed to the print station with a long edge as the leading edge, and the image is then printed on the top surface of the sheet in a stated right-reading direction, the spirit and scope of the invention is not to be limited thereto. Those skilled in the art will readily appreciate that these parameters of the printing process and the sheet feeding process can be varied to produce the same new and unusual result that is achieved by the embodiments of the invention as will be described, and such variations are to be considered to be within the spirit and scope of the invention.

The prior art provides various means for the corner binding of document sets. However, the problem of common-corner binding of portrait/landscape sets by a single non-movable binding means remains unsolved in the prior art.

For example, U.S. Pat. No. 4,687,191 shows a nested-bin sorter wherein the bins move apart to allow a stapler to move into the bin, to corner bind the set therein. No attempt is made to common-corner bind portrait and landscape sets. U.S. Pat. No. 4,681,310 is similar in construction and arrangement.

U.S. Pat. Nos. 4,083,550, 4,281,920, 4,329,046 and 4,564,185 also show attempts of workers in this art to combine set production and set binding. However, here again no attempt is made to common-corner bind portrait and landscape sets.

U.S. Pat. No. 4,238,066 teaches an arrangement to achieve corner set registration so as to bind the set with a stitcher, stapler or punch. No attempt is made to common-corner bind portrait and landscape sets.

When the present invention is applied to a copier device, it may be necessary to handle the original documents in a particular manner in order to achieve the correct page sequence and image orientation to achieve common-corner binding of both portrait and landscape sets. U.S. Pat. No. 4,650,313 is exemplary of means for handling original document pages to achieve a desired page sequence.

An object of the present invention is to provide the selective production of common-corner bound portrait or landscape document sets by feeding printed sheets from a print station to set accumulator means in a manner to stack portrait-printed and landscape-printed sheets with common-corner orientation. A corner binding means is then provided at a location that is coincident with the common-corner of the sets.

It is another object of the present invention is to provide for the production of common-corner bound portrait or landscape document sets by a print station that is capable of printing portrait or landscape images on a given surface of blank sheets. Sheets are fed from a supply of blank sheets with the same edge orientation for both portrait and landscape printing. Set accumulator means is located down stream from the print station, and sheets are fed to the set accumulator means in a manner to stack portrait-printed and landscape-printed sheets with common-corner orientation. A corner binding means is then provided at a location coincident with this common-corner.

It is a further object of the present invention to provide a method for operating a reproduction device, and to provide a reproducing apparatus such as an electrophotographic printer or copier, for producing common-corner bound sets, regardless of whether the set has been produced in a portrait mode of operation or in a landscape mode of operation. In this way, a binding means may be mounted at one corner of a set accumulator tray, i.e. the binding means need not move from one set corner to another in order to bind the set at the correct corner, regardless of whether the set has been produced in a portrait mode of operation, or a landscape mode of operation.

These and other objects and advantages of the invention will be apparent to those skilled in the art upon reference to the following detailed description of the invention, wherein reference is made to the drawing.

DETAILED DESCRIPTION OF THE INVENTION

Figure 3:
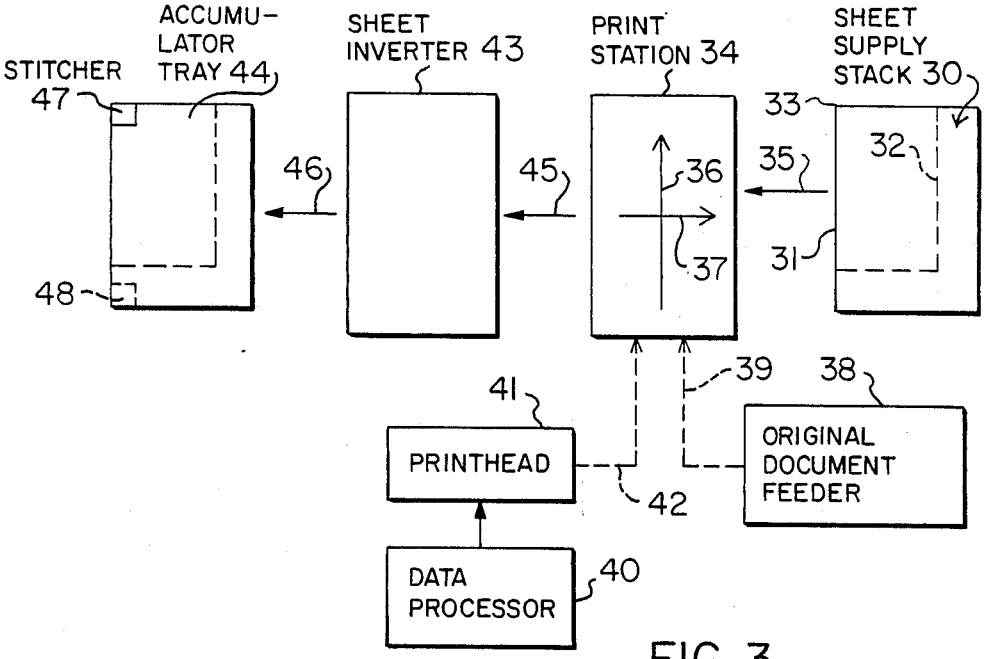
FIG. 3 is a view of a reproduction device constructed and arranged in accordance with a generic embodiment of the invention.

FIG. 3 is a showing of an embodiment of the invention wherein the means 34 for printing on sheets of blank paper 30 may be either a copier-like device 38, or a printhead 41 (i.e. an LED array, laser scanner, etc.) that is driven by an electronic image such as may be provided, for example, by a data processing means 40.

In FIG. 3 a stack of blank sheets that is to be printed on, one sheet at a time, is designated by numeral 30. This sheet stack is oriented so that its leading edge 31 is a long sheet edge, for example an 11 inch edge of the sheet. The dotted line 32 indicates that different size sheets may be used. However, for purposes of explanation, and not by way of limitation, all different size sheets are corner registered to corner 33 prior to being feed to print station 34 (see feed direction arrow 35).

At print station 34 an image is placed on the top surface of a sheet. In accordance with known techniques, the sheets may be simplex or duplex printed, but only simplex printing will be described with reference to FIG. 3.

Figure 1:
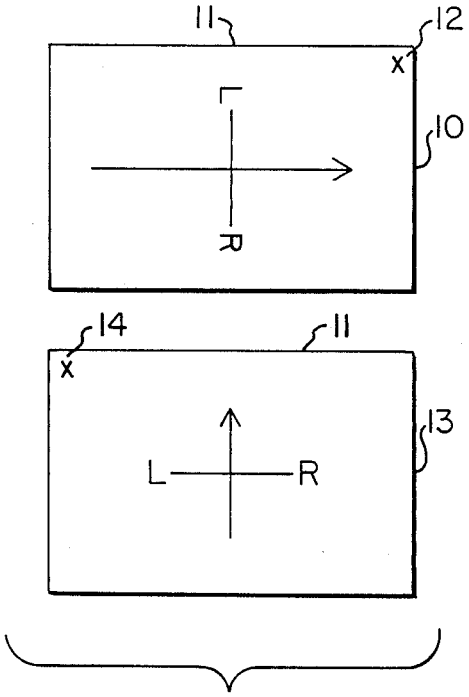
FIG. 1. PRIOR ART
FIG. 1 shows a prior art means for common-corner binding a portrait set and a landscape set.
Figure 2:
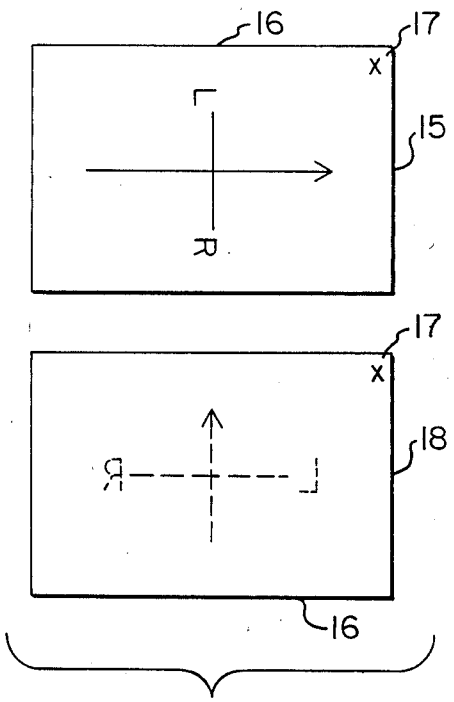
FIG. 2 is a showing of the common-corner binding of a portrait set and a landscape set in accordance with the invention.

In accordance with the prior explanation of FIG. 2, but without limitation thereto, the print station image orientation for simplex portrait is represented by arrow 36, and the image orientation for simplex landscape is represented by arrow 37. Images 36,37 are printed on the top side of the sheet being fed from stack 30, as the sheet passes through print station 34.

As those skilled in the art will appreciate, the image orientation 36,37 will change when the print station is configured to print on the bottom surface of a sheet, and when the sheet is feed short edge first. In addition, if sheet inversion is provided prior to print station 34, image orientation will of necessity change. All such print-station/sheet-feeding variations are to be considered within the spirit and scope of the present invention.

Print station 34 may take a variety of detailed forms. For example, when print station 34 comprises a portion of a copier like device, an original document feeder 38 and optical imaging means 39, both of which are well known to those skilled in the art, may be provided. When print station 34 comprises a portion of a computer output printer, the print station may include a data processor 40, a printhead 41 and an imaging path 42, all of which are well known to those skilled in the art.

The term "original document feeder" as used herein is intended to encompass the various known means for placing an original document on a glass platen for copying. Known document feeder means include manual placement of the document on the platen, and the use of mechanical devices such as semi-automatic document feeders (SADF), automatic document feeders (ADF) and recirculating automatic document feeders (RADF).

In accordance with an embodiment of the invention, a sheet invertor 43 and an accumulator tray or means 44 are located downstream of print station 34 (see feed direction arrows 45 and 46). Accumulator tray 44 includes a corner binding means in the form of a wire stitcher 47. Details of the construction and arrangement of invertor 43, tray 44 and stitcher 47 can take a number of forms, all of which are well known to those of skill in the art. Thus these details will not be described herein.

In the embodiment of the invention shown in FIG. 3, stitcher 47 is located at a leading-edge corner similar in position to the corner 33 of input stack 30. This corner also corresponds to corner 17 of FIG. 2. In this embodiment of the invention, and as was described relative FIG. 2, invertor 43 operates to invert only landscape printed sheets. In this way, the portrait printed sheets 15 and the landscape printed sheets 18 of FIG. 2 reside in tray 44 as above described relative FIG. 2, and both types of sheets are common-corner bound by operation of stitcher 47.

As was previously described, selection of different print parameters and/or sheet feeding parameters provide the option of mounting stitcher 47 at any one of the four corners of the set, for example at corner 48 if desired.

While it is possible to common-corner bind any one of the four corners of a set, it is usually more preferable to bind a leading edge corner 47,48 since during the feeding of sheets to tray 44 it is relatively easy to register the leading edges of the sheets against a registrations wall (not shown). In addition, when different size sheets are selectively used, all leading edge corners 47,48 of all different size sheets can be common-corner registered (using known techniques, not shown) for binding, as is represented by the dotted line within tray 44 of FIG. 3.

As those skilled in the art will appreciate, within the spirit and scope of the invention, the new and unusual concept of common-corner binding both portrait and landscape sets can be implemented by combinations of sheet inversion prior to printing, combined with proper image orientation on a specific side(s) of the sheet in order to produce the correct set orientation for binding at a common-corner; or sheet inversion after printing, combined with proper image orientation on a specific side(s) of the sheet in order to produce the correct set orientation for binding at a common-corner.

Figure 5:
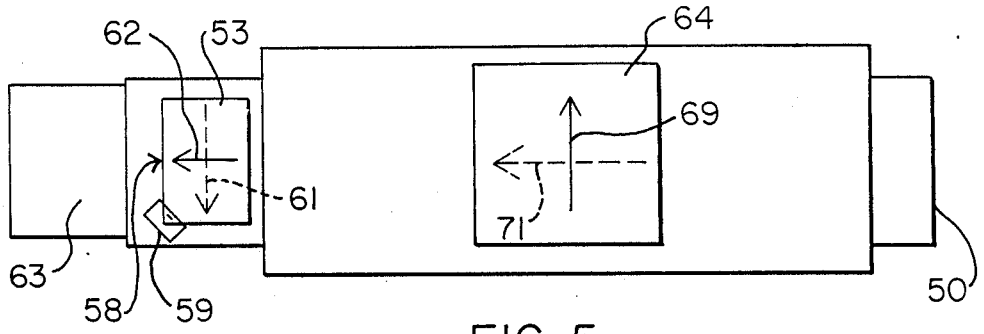
FIGS. 4 and 5 show a cop embodiment of the invention.
Figure 4:
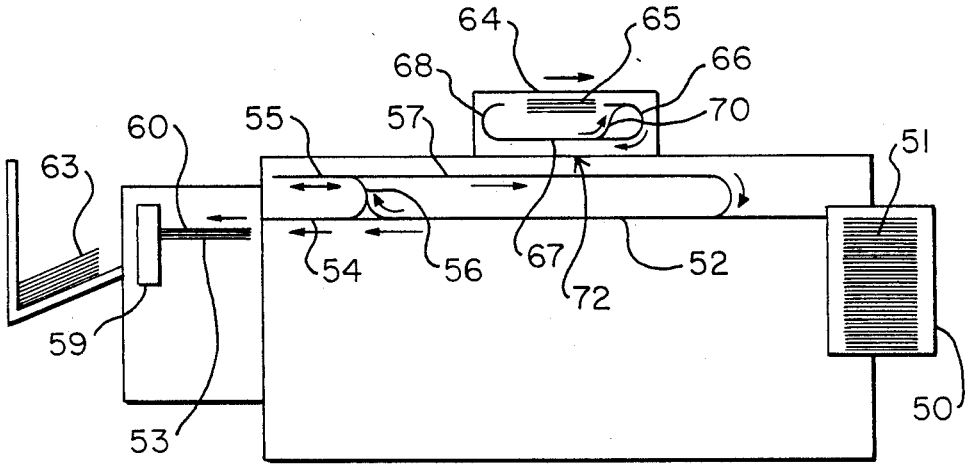

FIGS. 4 and 5 show the side view and the top view, respectively, of an embodiment of the invention wherein the reproduction device of the invention is a xerographic copier. In this embodiment the various operating stations of the well known xerographic process will not be described.

The blank paper supply for the copier comprises a bin 50 that is adapted to hold a vertical stack 51 of blank, cut, paper sheets. As seen in these figures, the sheets of paper are fed with a long sheet edge, i.e. the 11 inch sheet edge, as the leading edge. This manner of feeding paper is not however to be taken as a limitation on the invention.

Sheets from stack 51 are fed, one at a time, to a transfer station 52 where at a portrait or a landscape toner image is transferred to the bottom surface of the sheet. The sheet then moves from transfer station 52 to a fuser station (not shown).

If simplex copies are being produced, the sheet usually moves on to accumulator tray 53 by way of sheet feed path 54.

If duplex copies are being produced, the sheet moves on to sheet invertor or turnaround device 55 by way of sheet feed path 56. In the production of duplex copies the sheet next leaves invertor 55 by way of path 57, and returns to transfer station 52 with its original upper surface now facing downward. The second-side image is now placed on that surface of the sheet, to thereby form a duplex copy. After fusing of the second-side image, the duplex copy sheet moves on to accumulator tray 53 by way of sheet feed path 56, 55, 56 and 54.

As will be apparent, sheet path 56,55,56 is also used as a sheet invertor, similar in function to invertor 43 of FIG. 3, when producing landscape copies.

The leading edge of the sheets comprising a document copy set, i.e. either a simplex or a duplex set, are registered to a common vertical plane 58 (see FIG. 5), and a stapler device 59 is located at the front common-corner of this plane.

In accordance with the prior definition of the "common-corner" of both a portrait set and a landscape set, when the set 60 (see FIG. 4) within accumulator tray 53 is a portrait set, its image is represented by dotted arrow 61 (see FIG. 5), the image faces downward, and set page 1 is on the bottom of the set; and when the set 60 within accumulator tray 53 is a landscape set, its image is represented by an arrow 62, the image faces upward, and page 1 is on the top of the set.

In the embodiment of FIGS. 4 and 5, the bound sets are ejected, one set at a time, to an output collecting tray 63, in a manner well know to those skilled in the art.

The generic concept to be implemented in the FIG. 3 embodiment, in accordance with the invention, is the concept of coordinating operation of the printing means and the copy sheet feeding means to produce common-corner registration of both portrait and landscape sets, followed by the placing of a single, fixed-position, binding means at this common-corner location.

The required image orientation in accumulator tray 53, as above described, is controlled by the manner in which the original document is placed on the glass platen of the copier's imaging station 72, and by the use of sheet path 56, 55, 56 as a sheet invertor.

Placement of the original document sheets on the platen can be controlled by any of the well known document feeders, including manual placement of each original document sheet on the platen.

In the FIG. 4,5 embodiment the required image orientation is controlled by the use of RADF 64 which operates to feed sheets from the top of a stack 65, and to return sheets to the bottom of the stack.

More specifically, RADF 64 operates to feed a sheet from the top of an original document set 65, inverts the sheet in turnaround 66, and then feeds the sheet to a document imaging station 66 adjacent platen 72, where the sheet stops for copying. After copying of the sheet, the sheet is again inverted at turnaround 68, and then restacked to the bottom of set 65. RADF 64 is constructed and arranged such that a multi-sheet original document set 65 is manually loaded into RADF 64 with a long edge of the sheet oriented to the right (i.e. a long sheet edge will be the leading edge during sheet feeding).

If original document set 65 is a duplex set, RADF 64 operates to copy one side of a document sheet, and thereafter operates to invert the sheet by way of turnaround 70. The sheet is then returned to imaging station 67 for second-side copying. After copying the sheet's second-side image, the sheet is again inverted at 70, passes through imaging station 67 without copying, again inverted at turnaround 68, and is then restacked to the bottom of the set.

Portrait Image Copying

If set 65 is a simplex-portrait image set, and a like copy is to be made (i.e. simplex-portrait to simplex-portrait copying), the original document set 65 is manually loaded into RADF 64 with set page 1 on top facing up, and with the top of the portrait image facing toward the rear of the copier, as is represented by arrow 69 in FIG. 5.

In accordance with the well known 180 degree rotation optical principles of copying, the copying of this simplex-portrait set, page 1 being copied first (assuming that the set pages comprise pages 1 through N), followed by passing all sheets through path 54, produces the above described simplex-portrait set image orientation in accumulator tray 53 (see arrow 61). After copying, the original document sheet passes through RADF path 68 and is restacked to the bottom of the set. This process is repeated for each copy set that is required.

As will be apparent to those skilled in the art, the production of (1) simplex-portrait to duplex-portrait, (2) duplex-portrait to simplex-portrait, and (4) duplex-portrait to duplex-portrait copy sets requires the use of only known techniques of handling of the original document sheets and the copy sheets to produce copy sets that face downward, as indicated by dotted arrow 61 of FIG. 5. Thus, all of these types of portrait sets are likewise common-corner bound by the operation of stitcher 59.

Simplex-Landscape to Simplex-Landscape and to Duplex-Landscape

If set 65 is a simplex-landscape image set, and a simplex-landscape set is to be made therefrom, the original document set is manually loaded into RADF 64 with set page-1 on the bottom, facing down, and with the top of the landscape image facing toward the left, as is represented by dotted arrow 71 in FIG. 5.

RADF 64 now operates to invert the landscape set by operating in its flip mode of operation. In this mode of operation, each sheet of the simplex-landscape image set is sent through the sheet path 66,67,70,66,67,68 and then returned to the bottom of the stack. After this inversion, the simplex-landscape image set resides in the RADF with sheet N on the top and facing upward, and the top of the landscape image on the right.

In accordance with the well known 180 degree rotation optical principles of copying, the copying of this inverted simplex-landscape set, the top page N being copied first, followed by passing all sheets through inversion path 56,55,56,54 produces the above described simplex-landscape set image orientation in accumulator tray 53 (see arrow 62).

So long as more copy sets are to be made, the original document sheets are returned, after copying, to the bottom of the set by way of path 68.

After all of a requested number of copy sets have been made, the original document sheets passes through RADF path 70,66,67,68 after the last instance of copying, and are restacked to the bottom of the stack. This restores the simplex-landscape set to its original and correct page sequence.

If original document set 65 is a simplex-portrait set, and one or more duplex-portrait copy sets are to be made therefrom, the original document set sheets and the copy sheets are handled in a similar manner to that above described, the side-one copy sheet being additionally fed through path 57, as is usual when making duplex copies, and the finished two-sided copy sheet being inverted and then fed to tray 63.

Duplex-Landscape to Simplex-Landscape

The production of simplex-landscape copy sets from a duplex-landscape original set 65 requires that the duplex-landscape original set first be copied to prepare a simplex-landscape copy thereof. Once this simplex-landscape original document set has been prepared, multiple simplex-landscape copies are made therefrom as above described.

Duplex-Landscape to Duplex-Landscape

For the production of duplex-landscape copy sets from a duplex-landscape original set 65, the original set is loaded into RADF 64 with page 1 facing down, and with the top of the image facing to the left.

In this orientation of the original document set, the last page of the set (i.e. the set's highest even numbered page) faces upward. This top sheet of the set is now fed as the first sheet of the set to imaging station 67 for copying. The sheet is then fed through path 70,66, where the sheet is inverted, and the set's highest numbered odd page is returned to imaging station 67 for copying. During this inversion of the original document sheet, the corresponding copy sheet is inverted by way of path 56,55,57, and the sheet is returned to transfer station 52 to receive the image of the above mentioned highest numbered odd page.

After both sides of this top sheet of original document set 65 has been copied, it is returned to the bottom of the set stack by way of RADF path 68.

The duplex copy sheet that corresponds to this duplex original document sheet is now inverted by way of path 56,55,56, and then is fed to accumulator tray 53.

Note that after the first copy set has been produced as above described (and after the production of all subsequent odd numbered copy sets), the odd numbered pages of the original document set 65 now face upward, page 1 is on top of RADF stack 65, and stack 65 is in its correct page sequence.

In order to produce the second copy set (and all subsequent even numbered copy sets), the original document set is again recirculated, copying both sides of each sheet, and then returning each sheet to the bottom of RADF stack 65. In the case of preparing the second (and all subsequent even numbered copy sets), the sheet of the set are fed to accumulator 53 directly by way of path 54, without the inversion that occurs with odd numbered copy sets.

If the last copy set to be made is an even numbered set, the original document set may be circulated through RADF 64, as above described, and without copying, in order to restore the set to its correct page-/image sequence, for unloading from the RADF.

The above description of preferred embodiments of the present invention will make other embodiments thereof apparent to those skilled in the art. Particularly it is noted that the configuration of the reproduction device, and the manner of feeding original document sheets and copy sheets, will determine the exact way in which the invention will be implemented in a particular device. Therefore, the scope and content of the invention is not to be limited by the above detailed description of preferred and exemplary embodiments of the invention.

I claim as my invention:

1. A method for selectively producing common-corner bound portrait or landscape document sets, comprising the steps of, providing a print station capable of printing portrait or landscape images on a given surface of a blank sheet, providing a supply of blank sheets to be printed by said print station, feeding sheets from said supply of sheets with the same edge orientation for both portrait and landscape printing, providing set accumulator means located down stream of said print station, feeding sheets from said print station to said set accumulator means in a manner to stack portrait-printed and landscape-printed sheets with a common-corner orientation, and providing corner binding means at said set accumulator means at a location coincident with said common-corner orientation.

2. The method of claim 1 wherein said print station includes a printhead and electronic image means providing an image to be reproduced.

3. The method of claim 1 wherein said print station includes an original document feeder and optical image means providing an image to be reproduced.

4. The method of claim 1 including the step of location said corner binding means coincident with a common leading edge corner of said portrait-printed and landscape-printed sheets.

5. The method of claim 1 including the step of relatively inverting one of said portrait and said landscape sets prior to feeding the sheets thereof from said print station to said set accumulator means, to thereby produce common-corner binding of said portrait and said landscape sets by said fixed-location corner binding means.

6. The method of claim 5 including the step of location said corner binding means coincident with a common leading edge corner of said portrait-printed and landscape-printed sheets.

7. The method of claim 6 wherein said print station includes a printhead and electronic image means providing an image to be reproduced.

8. The method of claim 6 wherein said print station includes an original document feeder and optical image means providing an image to be reproduced.

9. Apparatus for selectively producing common-corner bound portrait or landscape document sets, comprising;

print means capable of selectively printing portrait or landscape images on a blank sheet, supply means containing blank sheets to be printed by said print means, set accumulator means located down stream of said print means, sheet feeding means for blank feeding sheets from said supply means and for feeding printed sheets from said print means to said set accumulator means, means coordinating operation of said printing means and said sheet feeding means in a manner to stack portrait-printed and landscape-printed sheets at said set accumulator means with common-corner orientation, and corner binding means mounted at said set accumulator means at a location coincident with said common-corner orientation.

10. The apparatus of claim 9 wherein said print means includes a printhead and electronic image means providing a set of images to be reproduced.

11. The apparatus of claim 9 wherein said print means includes an original document feeder and optical image means providing a set of images to be reproduced.

12. The apparatus of claim 9 wherein said corner binding means is located coincident with a common leading edge corner of said portrait-printed and landscape-printed sheets.

13. The apparatus of claim 9 wherein said sheet feeding means comprises first sheet feeding means for feeding sheets from said supply means with the same edge orientation for both portrait and landscape printing, and second sheet feeding means for feeding sheets from said print means to said set accumulator means in a manner to stack portrait-printed and landscape-printed sheets with a common-corner orientation.

14. The apparatus of claim 13 wherein said second sheet feeding means operates to relatively invert one of said portrait and said landscape sets prior to feeding the sheets thereof from said print means to said set accumulator means, to thereby produce common-corner binding of said portrait and said landscape sets by said fixed-location corner binding means.

15. The apparatus of claim 14 wherein said corner binding means is located coincident with a common leading edge corner of said portrait-printed and landscape-printed sheets.

16. The apparatus of claim 15 wherein said print means includes a printhead and electronic image means providing an image to be reproduced.

17. The apparatus of claim 15 wherein said print means includes an original document feeder and optical image means providing an image to be reproduced.

18. Copier apparatus for selectively producing common-corner bound portrait or landscape document sets, from an original document set, comprising;

transfer station means capable of selectively forming a toner portrait image or a toner landscape image on a surface of a blank sheet in accordance with the type of original document set being copied, supply means containing blank sheets on which toner images are to be formed, set accumulator means located down stream of said transfer station means, sheet feeding means for blank feeding sheets from said supply means and for feeding printed sheets from said transfer station means to said set accumulator means, means coordinating operation of said transfer station means and said sheet feeding means in a manner to stack portrait-copied sheets and landscape-copied sheets at said set accumulator means with common-corner orientation, in accordance with the type of original document set being copied, and corner binding means mounted at said set accumulator means at a location that is coincident with said common-corner orientation.

19. The apparatus of claim 18 wherein said copier apparatus includes original document feeder means and optical image means providing a corresponding set of images to be copied.

20. The apparatus of claim 19 wherein said corner binding means is located coincident with a common leading edge corner of said portrait-copied and said landscape-copied sheets.

21. The apparatus of claim 20 wherein said sheet feeding means comprises first sheet feeding means for feeding sheets from said supply means with the same edge orientation for both portrait and landscape copying, and second sheet feeding means for feeding sheets from said transfer station means to said set accumulator means in a manner to stack portrait-copied and landscape-copied sheets with a common-corner orientation.

22. The apparatus of claim 21 wherein said second sheet feeding means relatively invert all of the sheets of one of said portrait-copied and said landscape-copied sets prior to feeding the sheets thereof to said set accumulator means, to thereby produce common-corner binding of said portrait-copied and said landscape-copied sets by said fixed-location corner binding means.

* * * * *